US009418615B2

(12) United States Patent
Tseng

(10) Patent No.: US 9,418,615 B2
(45) Date of Patent: Aug. 16, 2016

(54) VOLTAGE GENERATOR

(71) Applicant: HIMAX TECHNOLOGIES LIMITED, Tainan (TW)

(72) Inventor: Wei-Kai Tseng, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 500 days.

(21) Appl. No.: 13/911,059

(22) Filed: Jun. 5, 2013

(65) Prior Publication Data

US 2014/0361967 A1 Dec. 11, 2014

(51) Int. Cl.
*G09G 3/00* (2006.01)
*G09G 3/36* (2006.01)

(52) U.S. Cl.
CPC ..... *G09G 3/3696* (2013.01); *G09G 2320/0276* (2013.01)

(58) Field of Classification Search
CPC ..... G09G 3/3696; G09G 3/3688; G09G 3/36; H03M 1/069
See application file for complete search history.

(56) References Cited

U.S. PATENT DOCUMENTS 6,750,839 B1 * 6/2004 Hogan ..... G09G 3/3688 345/89
2004/0257254 A1 * 12/2004 Jiang ..... H03M 1/0682 341/145

FOREIGN PATENT DOCUMENTS

| | | |
|---|---|---|
| CN | 101257017 A | 9/2008 |
| TW | I227456 | 2/2005 |
| TW | I348087 | 9/2011 |

* cited by examiner

*Primary Examiner* — Michael Faragalla
(74) *Attorney, Agent, or Firm* — Winston Hsu; Scott Margo

(57) ABSTRACT

A voltage generator for providing a plurality of output voltages having different levels includes: a reference block and a plurality of digital-to-analog conversion blocks. The reference block is employed for providing a plurality of reference voltages according to a supply voltage. The plurality of digital-to-analog conversion blocks is coupled to the reference block, and each of the digital-to-analog conversion blocks receives the reference voltages and generates a digital-to-analog output voltage according to a digital code, wherein digital-to-analog output voltages generated by the digital-to-analog conversion blocks have different levels, respectively. In addition, a range of the digital-to-analog output voltage generated by a first digital-to-analog conversion block of the digital-to-analog conversion blocks is different from that of the digital-to-analog output voltage generated by a second digital-to-analog conversion block.

9 Claims, 8 Drawing Sheets

VOLTAGE GENERATOR

BACKGROUND OF THE INVENTION

1. Field of the Invention

The present invention relates to driving circuitry of liquid crystal display. More particularly, the present invention relates to a voltage generator for a source driver of a liquid crystal display system.

2. Description of the Prior Art

A liquid crystal display (LCD) displays images by controlling transmittance of incident light emitted from a light source using optical anisotropy of liquid crystal molecules and polarization characteristics of a polarizer filter.

Each pixel of an LCD typically consists of a layer of molecules aligned between two electrodes. Voltages of managing and controlling of the data to be displayed is generated by driving circuits, one of which is often denoted as a gate driver while the other of which is denoted as a source driver. The source driver generates voltages of controlling the data to be displayed which will be applied to the two electrodes. These voltages control the transmittances of liquid crystal molecules to make pixels have different luminance so as to present an image.

In generally, the source driver requires a gamma reference voltage generator, which outputs a plurality of gamma reference voltages. The source driver utilizes these voltages to create different driving voltages to drive pixels. An example of a prior-art gamma reference voltage is depicted in FIG. 1. At first, a supply voltage VDDA provided by a power supply device is inputted to a resistor string. The resistor string produces a plurality of fractional parts of the supply voltage VDDA, $V_{REF1}$-$V_{REFN}$. The voltages $V_{REF1}$-$V_{REFN}$ are provided to multiple DAC blocks to generate a plurality of gamma reference voltages $V_{O1}$-$V_{OM}$. The source driver will use these gamma reference voltages $V_{O1}$-$V_{OM}$ to generate driving voltages for each pixel. Such a gamma reference voltage generator has two disadvantages: 1) noises due to poor power supply rejection ratio (PSRR) of the power supply device; 2) large size of the multiples DAC blocks.

Therefore, there is a need to provide an inventive voltage generator to address the above-mentioned problems.

SUMMARY OF THE INVENTION

With this in mind, it is one objective of the present invention to provide a voltage generator that has good immunity against noises caused by the poor PSSR of the power supply device. In addition, it is another objective of the present invention to provide a voltage generator that has a reduced size by properly arranging cover ranges of output voltages provided by the voltage generator.

According to one embodiment of the present invention, a voltage generator for providing a plurality of output voltages having different levels is provided, which comprises: a reference block and a plurality of digital-to-analog conversion blocks. The reference block is employed for providing a plurality of reference voltages according to a supply voltage. The plurality of digital-to-analog conversion blocks is coupled to the reference block, and each of the digital-to-analog conversion blocks receives the reference voltages and generates a digital-to-analog output voltage according to a digital code, wherein digital-to-analog output voltages generated by the digital-to-analog conversion blocks have different levels, respectively and are used to generate the output voltages. In addition, a range of the digital-to-analog output voltage generated by a first digital-to-analog conversion block of the digital-to-analog conversion blocks is different from that of the digital-to-analog output voltage generated by a second digital-to-analog conversion block.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following descriptions and claims to refer to particular system components. As one skilled in the art will appreciate, manufacturers may refer to a component by different names. This document does not intend to distinguish between components that differ in name but not differ in functionality. In the following discussion and in the claims, the terms "include", "including", "comprise", and "comprising" are used in an open-ended fashion, and thus should be interpreted to mean "including, but not limited to . . . " The terms "couple" and "coupled" are intended to mean either an indirect or a direct electrical connection. Thus, if a first device couples to a second device, that connection may be through a direct electrical connection, or through an indirect electrical connection via other devices and connections.

Figure 1:
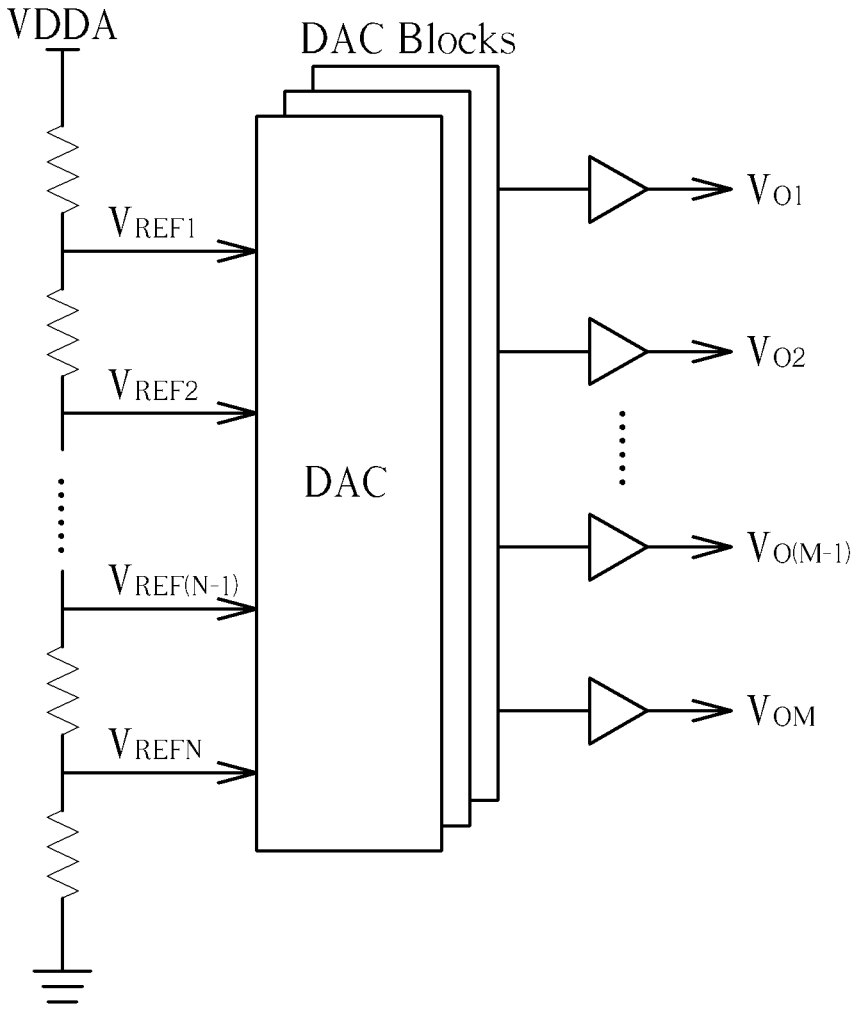
FIG. 1 PRIOR ART
FIG. 1 is a diagram of a prior-art gamma reference voltage generator.
Figure 2:
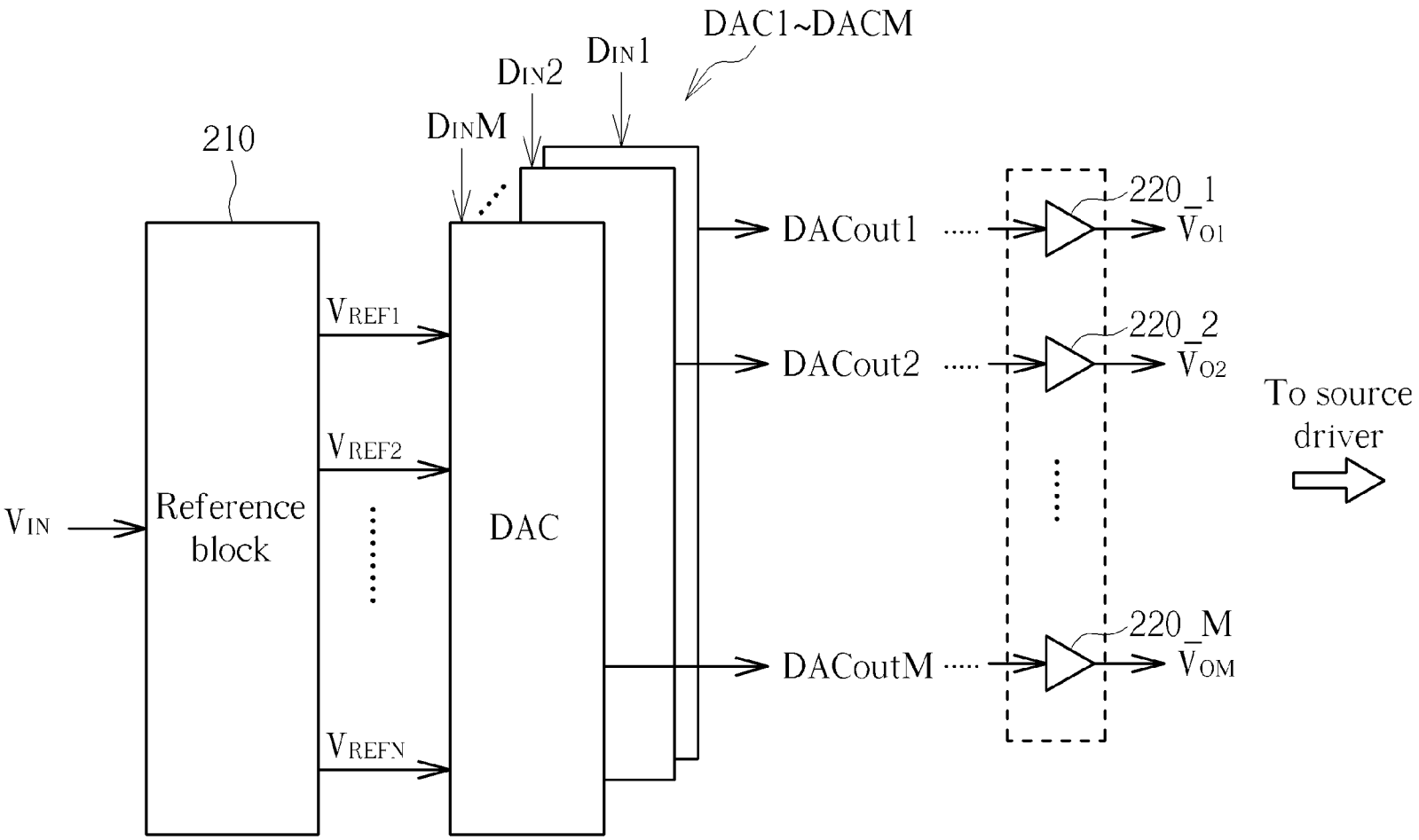
FIG. 2 is a diagram of a voltage generator according to one embodiment of the present invention.

With reference to FIG. 2, a voltage generator 200 is depicted according to one embodiment of the present invention. The voltage generator 200 is utilized for providing a plurality of output voltages $V_{O1}$-$V_{OM}$ of different levels to be gamma reference voltages for a source driver. The voltage generator 200 comprises a reference block 210 and a plurality of digital-to-analog conversion blocks DAC1-DACM. The reference block 210 is employed for providing a plurality of reference voltages $V_{REF1}$-$V_{REFN}$ according to a supply voltage $V_{IN}$. The digital-to-analog conversion blocks DAC1-DACM are coupled to the reference block 210. Digital-to-analog conversion blocks DAC1-DACM receive the reference voltages $V_{REF1}$-$V_{REFN}$ and generate digital-to-analog output voltages DACout1-DACoutM have different levels according to digital codes $D_{IN}1$-$D_{IN}M$.

Preferably, the digital-to-analog conversion blocks DAC1-DACM are R-string digital-to-analog converter (DAC). Therefore, each of the digital-to-analog conversion blocks DAC1-DACM selects one of reference voltages $V_{REF1}$-$V_{REFN}$ by controlling switches thereof according to the digital codes $D_{IN}1$-$D_{IN}M$. The reference block 210 uses a resistor string to provide a plurality of reference voltages $V_{REF1}$-$V_{REFN}$ to each of the digital-to-analog conversion blocks DAC1-DACM. Each of the reference voltages $V_{REF1}$-$V_{REFN}$ is a fractional parts of the supply voltage $V_{IN}$.

Figure 4:
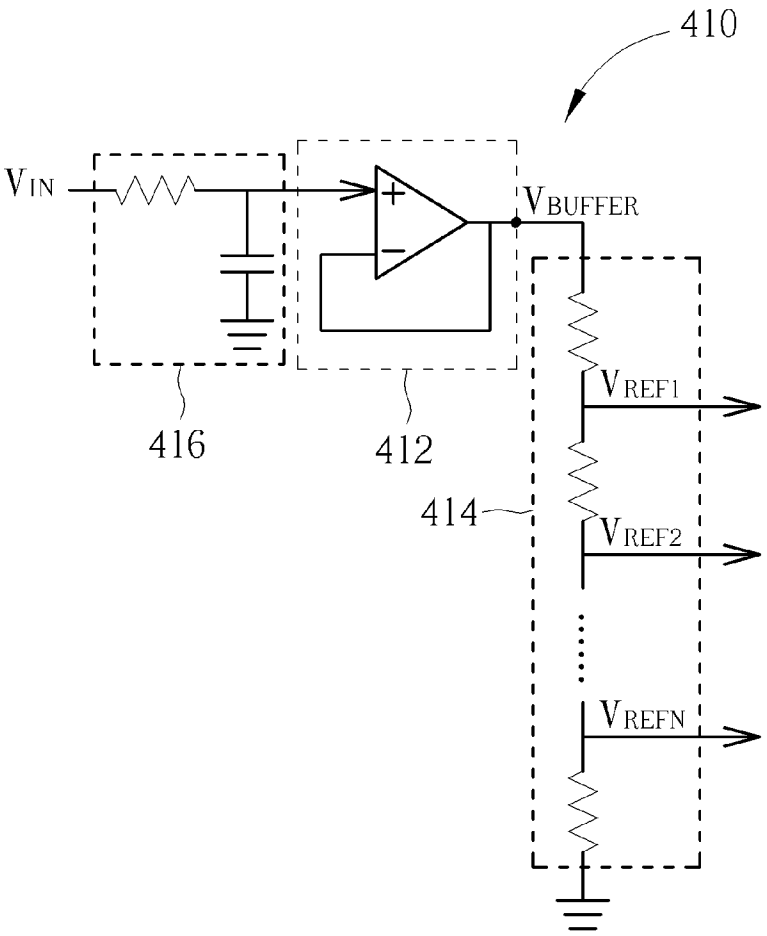
FIG. 4 is a circuit diagram of a reference block of the voltage generator as shown in FIG. 2 of according to a second embodiment the present invention.
Figure 3:
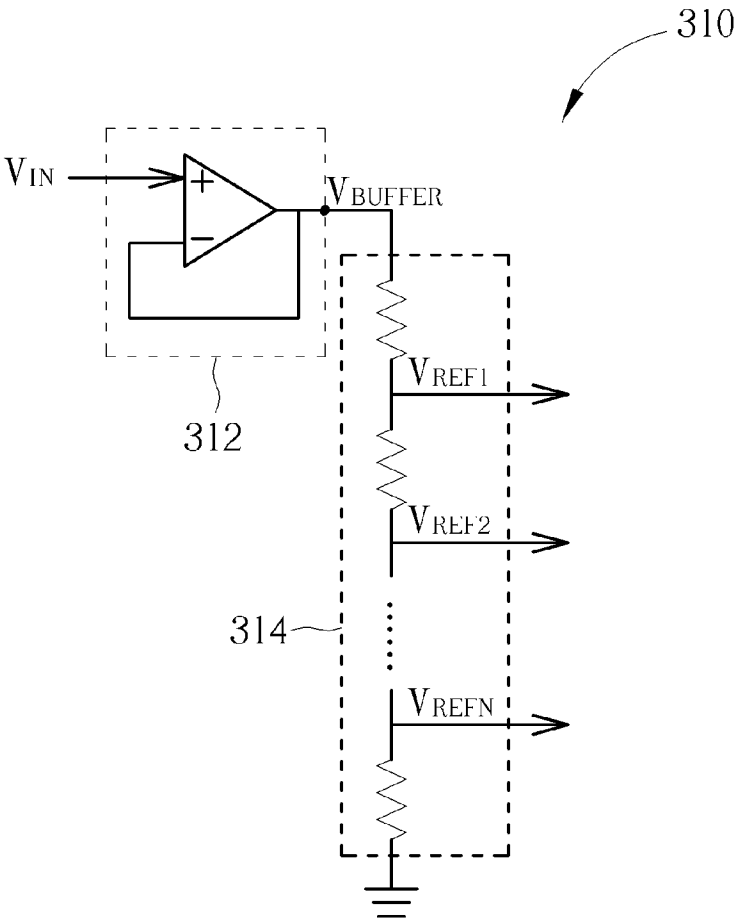
FIG. 3 is a circuit diagram of a reference block of the voltage generator as shown in FIG. 2 according to a first embodiment of the present invention.

The supply voltage $V_{IN}$ can be derived from an output node of a regulator (with fewer noises) or directly from a power supply device. If the supply voltage $V_{IN}$ is derived from a regulator and does not have strong driving capability, a buffer circuit is necessary to isolate the load (e.g. DAC blocks) from the output node. Please refer to FIG. 3, which depicts a circuit diagram of a reference block according to a first embodiment of the present invention. As depicted, the reference block 310 comprises a buffer circuit 312 and a resistor string 314. At first, the supply voltage $V_{IN}$ is inputted to the buffer circuit 312. The buffer circuit 312 (may be a unity gain amplifier) outputs a buffered voltage $V_{BUFFER}$, and then the resistor string 314 divides the buffered voltage $V_{BUFFER}$ to produce the reference voltages $V_{REF1}$-$V_{REFN}$. In a second embodiment of the present invention, the reference block further comprises a filter circuit. Please refer to FIG. 4. The supply voltage $V_{IN}$ is inputted to the filter circuit 416 prior to the buffer circuit 412. In a subsequence, the resistor string 414 divides $V_{BUFFER}$ to produce the reference voltages $V_{REF1}$-$V_{REFN}$. Because of noise reduction of the filter circuit 416, the supply voltage $V_{IN}$ can be even extracted from the power supply device having poor PSRR.

Figure 5:
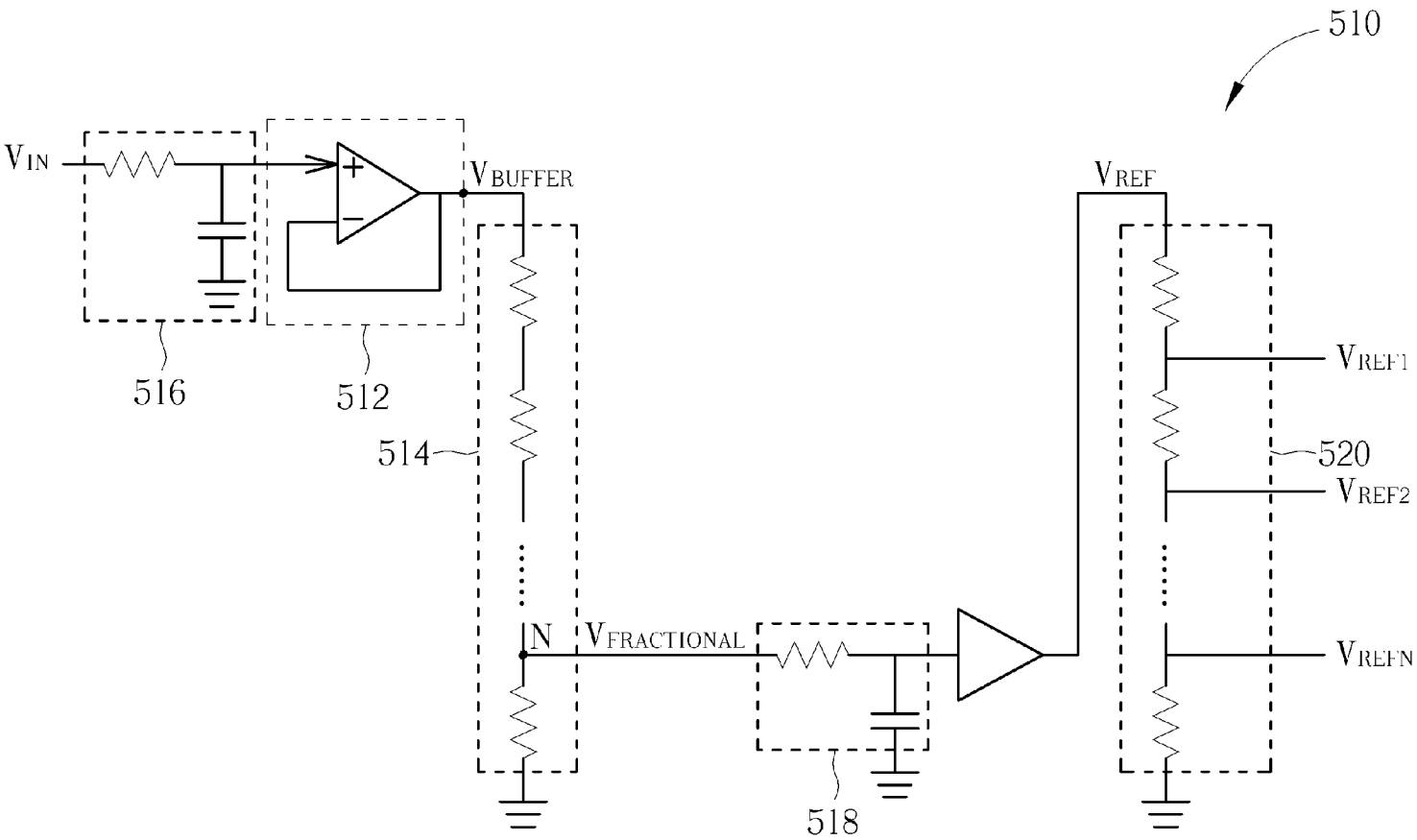
FIG. 5 is a circuit diagram of a reference block of the voltage generator as shown in FIG. 2 of according to a third embodiment the present invention.

In a third embodiment, the reference block may have more than one filter circuit. Please refer to FIG. 5, which depicts a reference block 510 according to one embodiment of the present invention. The reference block 510 includes a first filter circuit 516 for filtering the supply voltage $V_{IN}$ and a second filter circuit 518 for filtering an output of the buffer circuit 512. In this embodiment, a voltage $V_{FRACTIONAL}$ which is 1/N of the buffered voltage $V_{BUFFER}$ at node N of the first resistor string 514 will be extracted and be filtered by the second filter circuit 518 to generate an output. This output will be further inputted to another buffer 522 to generate the voltage $V_{REF}$. Afterwards, the second resistor string 520 divides the voltage $V_{REF}$ to produce the reference voltages $V_{REF1}$-$V_{REFN}$.

Figure 6:
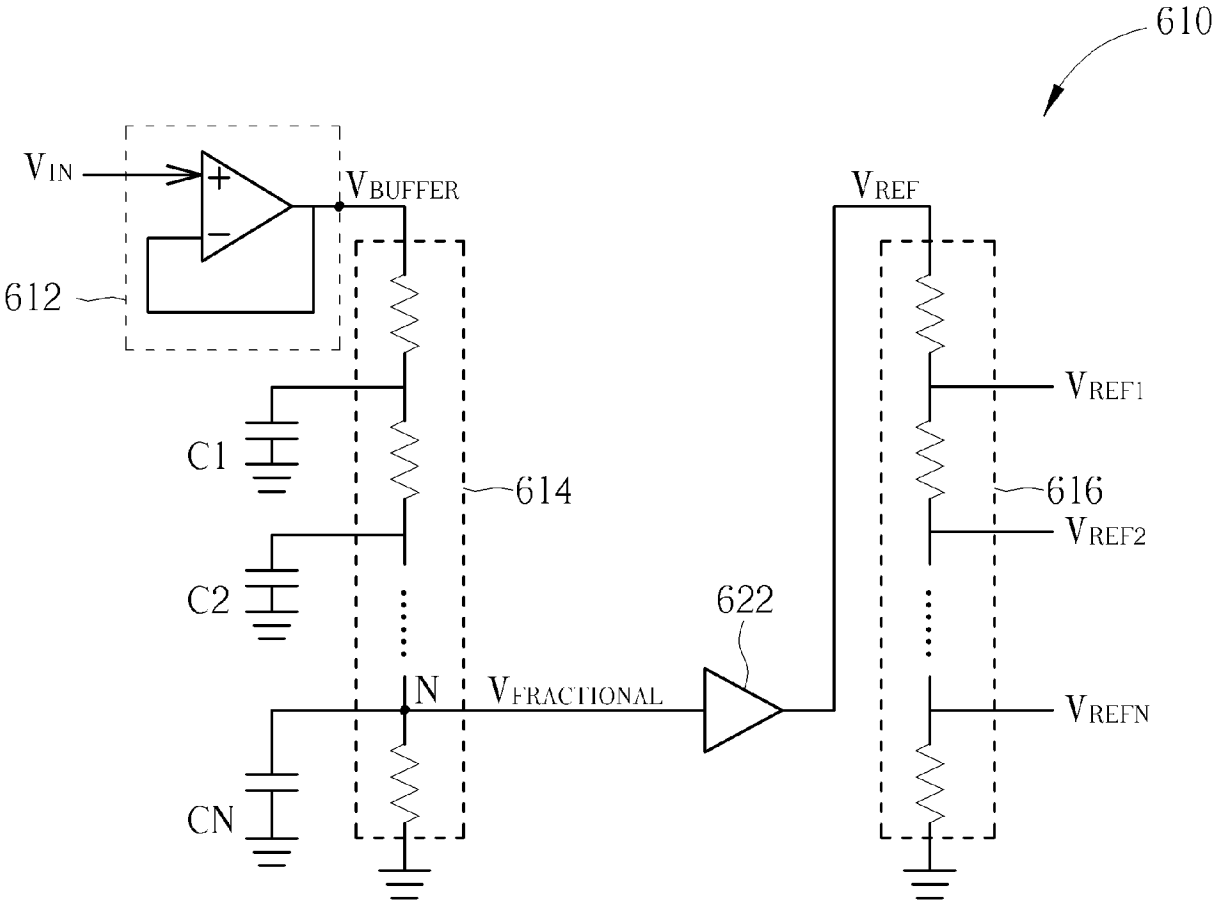
FIG. 6 is a circuit diagram of a reference block of the voltage generator as shown in FIG. 2 of according to a fourth embodiment the present invention.

In fourth embodiment, the reference block may have a high-order filter which is accomplished by adding a plurality of capacitors to nodes between any two of the resistors of the first resistor string. Please refer to FIG. 6, which depicts a reference block 610 according to the fourth embodiment of the present invention. Each of capacitor C1-CN is coupled to a node between two of the resistors of the first resistor string 614. Therefore, the capacitor C1-CN and the first resistor string 614 forms a high-order filter. A voltage $V_{FRACTIONAL}$ which is both filtered and fractional will be sent to a buffer 622. An output of the buffer 622 will be sent to the second resistor string 616 to produce the reference voltages $V_{REF1}$-$V_{REFN}$.

Figure 7:
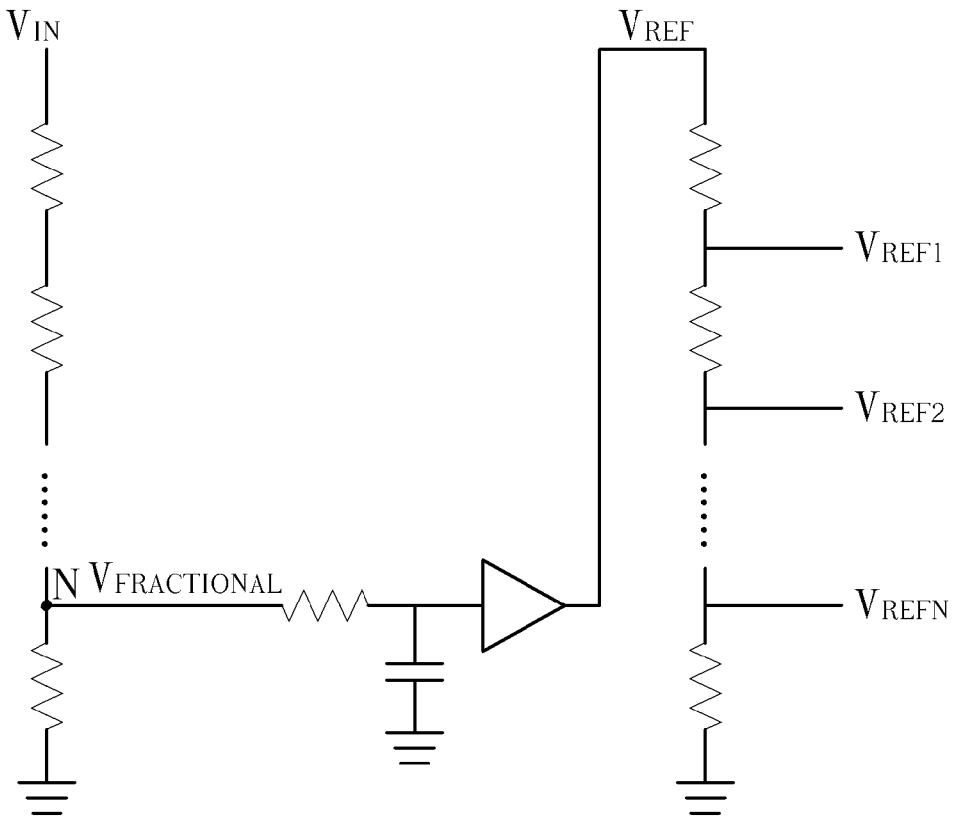
FIG. 7 is a circuit diagram of a reference block of the voltage generator as shown in FIG. 2 of according to a fifth embodiment the present invention.
Figure 8:
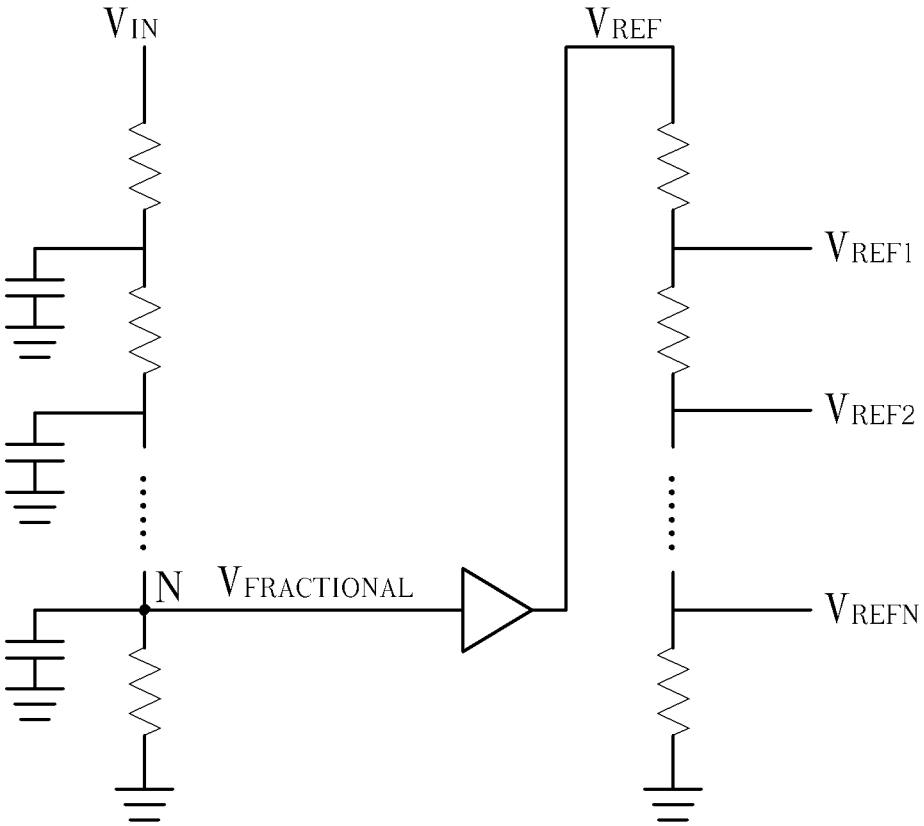
FIG. 8 is a circuit diagram of a reference block of the voltage generator as shown in FIG. 2 of according to a sixth embodiment the present invention.

If a source of the supply voltage $V_{IN}$ has enough driving capability, the buffered circuit at the input may be saved. Such embodiments are depicted in FIG. 7 and FIG. 8. As depicted, the first resistor string provides a filtered and divided voltage according to supply voltage $V_{IN}$, which will be further sent to the buffers. Then, the output of the buffers will be sent to the second resistor string to produce the reference voltages $V_{REF1}$-$V_{REFN}$.

In the above-mentioned cases, if the reference voltages $V_{REF1}$-$V_{REFN}$ are generated according to a fractional voltage $V_{FRACTIONAL}$ of the supply voltage $V_{IN}$ (e.g. embodiments in FIGS. 5, 6, 7, and 8, a plurality of gain units 220_1-220_M are necessary to compensate the level of the reference voltages $V_{REF1}$-$V_{REFN}$. Each gain unit will multiply the reference voltages $V_{REF1}$-$V_{REFN}$ by a fractional factor of $V_{FRACTIONAL}$ in respect to the supply voltage $V_{IN}$.

Figure 9:
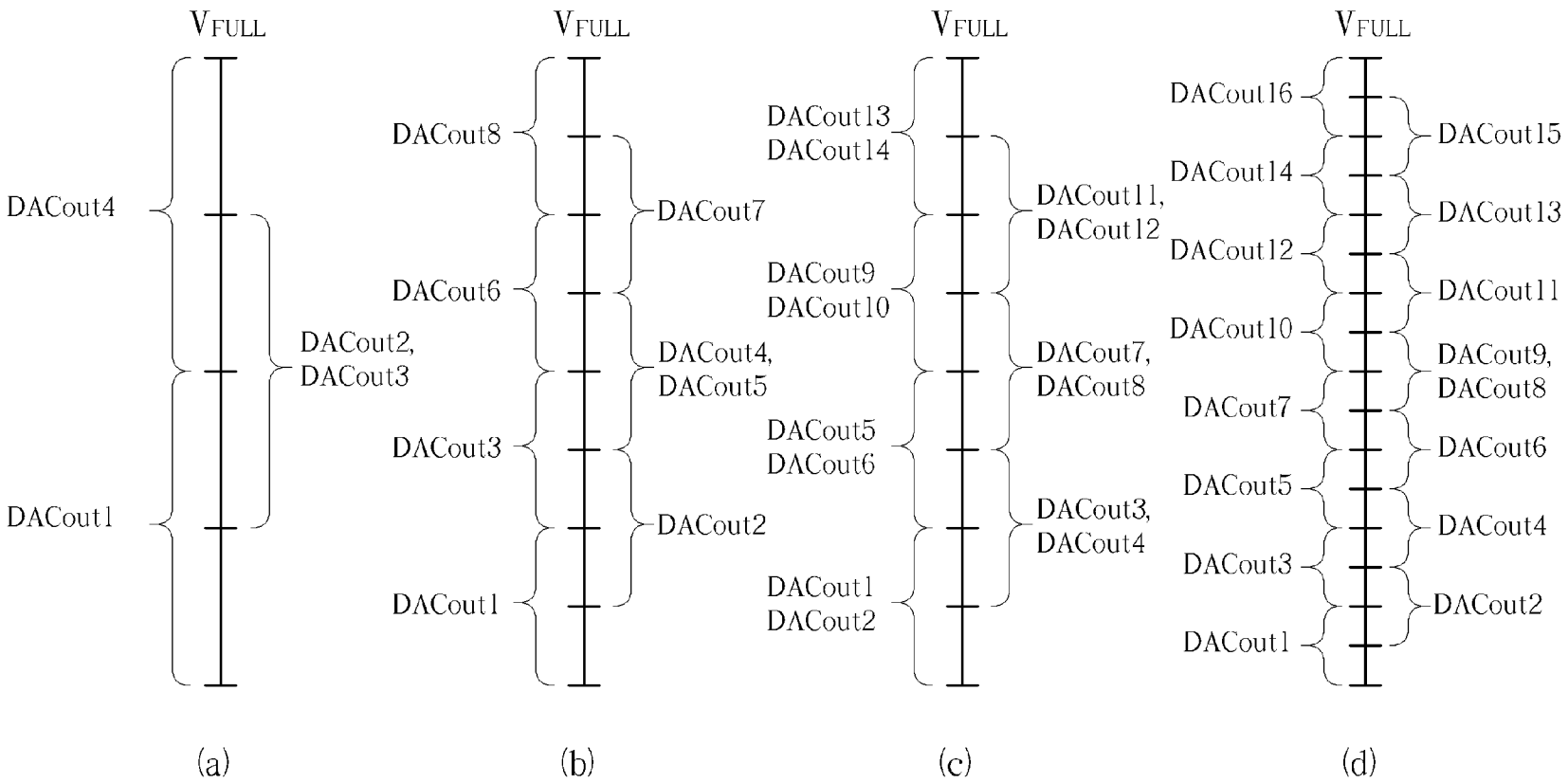
FIG. 9 is a diagram illustrating covering range of output voltages provided by a voltage generator according to one embodiment of the present invention.

Since the number of the output voltages $V_{O1}$-$V_{OM}$ is considerable, the circuit size of the digital-to-analog conversion blocks DAC1-DACM will become very large. In order to save the circuit size of the digital-to-analog conversion blocks DAC1-DACM, the present invention provides a method to address such problem. This is achieved by reducing the covering range of the digital-to-analog output voltages DACout1-DACoutM. In the prior art, each of the digital-to-analog conversion blocks DAC1-DACM will be designed to cover a full range voltage $V_{FULL}$. For example, if a source driver requires the gamma reference voltages from 16V to −16V, each of the digital-to-analog conversion blocks DAC1-DACM are designed to cover a full range of 32V. However, this is unnecessary because the source driver may only require one gamma reference voltage around 16V and requires other gamma reference voltages from −16V to 14V. In other words, only one of the digital-to-analog conversion blocks DAC1-DACM is required to provide an output voltage covering a range of 14V-16V while the others of the digital-to-analog conversion blocks DAC1-DACM just needs to provide output voltages covering a range of −16V~14V. Therefore, the present invention restricts the covering range of each of the output voltages DACout1-DACoutM to thereby reduce the complexity of the circuitry of the digital-to-analog conversion blocks DAC1-DACM. For example, in the case (a) of FIG. 9, each of the output voltages DACout1-DACout3 only covers half the full range of $V_{FULL}$ (e.g. 32V). Therefore, the digital-to-analog conversion blocks DAC1-DAC3 will have half the size of digital-to-analog conversion blocks under the full-range design. Further, in the case (b) of FIG. 9, each of the output voltages DACout1-DACout8 only covers ¼ of the full range of $V_{FULL}$ (e.g. 32V). Therefore, the digital-to-analog conversion blocks DAC1-DAC8 will have ¼ of the size of the full-range design blocks. If the source driver requires two gamma reference voltages whose levels are close to each other, the present invention uses two digital-to-analog conversion blocks to generate digital-to-analog output voltages covering a same range, such as case (c) in FIG. 9. The case (d) in FIG. 9 gives another example of the covering range arrangement.

When the digital-to-analog conversion blocks DACout1-DACoutM are not required to provide a full range covering, it is unnecessary for the digital-to-analog conversion blocks DACout1-DACoutM to receive all of the reference voltages $V_{REF1}$-$V_{REFN}$ provided by the reference block. Therefore, in one embodiment, each of the digital-to-analog conversion blocks DACout1-DACoutM only receives a portion of the reference voltages $V_{REF1}$-$V_{REFN}$ to generate the digital-to-analog output voltages DACout1-DACoutM.

Reference in the specification to "one embodiment" or "an embodiment" means that a particular feature, structure, or characteristic described in connection with the embodiment is included in at least an implementation. The appearances of the phrase "in one embodiment" in various places in the specification are not necessarily all referring to the same embodiment. Thus, although embodiments have been described in language specific to structural features and/or methodological acts, it is to be understood that claimed subject matter may not be limited to the specific features or acts described. Rather, the specific features and acts are disclosed as sample forms of implementing the claimed subject matter.

The present invention addresses the noise problems encountered by the prior art voltage generator by using a reference block with the filter circuit and the buffer circuit as well as the circuit size problem using the digital-to-analog conversion blocks reduced sizes under proper covering range arrangement.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage generator, for providing a plurality of output voltages having different levels, comprising:

a reference block, for providing a plurality of reference voltages according to a supply voltage, comprising:

a first resistor string, having a plurality of resistors coupled in series, for receiving the supply voltage and outputting a divided reference voltage at a node between two resistors, wherein each of the digital-to-analog conversion blocks generates the digital-to-analog output voltage according to the divided reference voltage; and a second resistor string, coupled to the first resistor string, for outputting a plurality of reference voltages according to the divided reference voltage outputted by the first resistor string, wherein each of the digital-to-analog conversion blocks receives the reference voltages and generates the digital-to-analog output voltage by selecting one of the reference voltages; and a plurality of digital-to-analog conversion blocks, coupled to the reference block, each receiving the reference voltages and generating a digital-to-analog output voltage according to a digital code, wherein digital-to-analog output voltages generated by the digital-to-analog conversion blocks have different levels, respectively and are used to generate the output voltages;

wherein a range of the D/A output voltage generated by a first digital-to-analog conversion block of the digital-to-analog conversion blocks is different from that of the digital-to-analog output voltage generated by a second digital-to-analog conversion block, and the range of the digital-to-analog output voltage generated by the first digital-to-analog conversion block of the digital-to-analog conversion blocks partially overlaps that of the digital-to-analog output voltage generated by the second digital-to-analog conversion block.

2. The voltage generator of claim 1, wherein the reference block comprises:

a buffer circuit, for outputting a buffered voltage according to the supply voltage, wherein each of the digital-to-analog cover blocks generates the digital-to-analog output voltage according to the buffered voltage.

3. The voltage generator of claim 2, wherein the reference block comprises:

a filter circuit, coupled to an input of the buffer circuit, for filtering the supply voltage to generate a filtered supply voltage, wherein the buffer stage outputs the buffered voltage according to the filtered supply voltage.

4. The voltage generator of claim 2, wherein the reference block comprises:

a resistor string, having a plurality of resistors coupled in series, coupled to the buffer circuit, for outputting a plurality of reference voltages to each of the digital-to-analog conversion blocks according to the buffered voltage, wherein each of the digital-to-analog conversion blocks receives the reference voltages and generates the digital-to-analog output voltage by selecting one of the reference voltages.

5. The voltage generator of claim 1, wherein the reference block comprises:

a filter circuit, coupled to the node, for filtering the divided reference voltage to generate a filtered divided reference voltage, wherein each of the digital-to-analog conversion blocks generates the digital-to-analog output voltage according to the filtered divided reference voltage.

6. The voltage generator of claim 1, wherein the reference block comprises:

a plurality of capacitors, each coupled to a node between two of the resistors of the first resistor string to form a high-order filter, wherein each of the digital-to-analog conversion blocks generates the output voltage according to a filtered divided reference voltage that is generated by the high-order filter.

7. The voltage generator of claim 1, further comprising:

a plurality of gain units, each coupled to one of digital-to-analog conversion blocks, for gaining the digital-to-analog output voltage generated by each of the digital-to-analog conversion blocks to generate the output voltages of the voltage generator.

8. The voltage generator of claim 1, wherein a range that is covered by all of the digital-to-analog output voltages is greater than the range of the digital-to-analog output voltage generated by each of the digital-to-analog conversion blocks.

9. The voltage generator of claim 1, wherein each of the digital-to-analog conversion blocks receives a portion of the reference voltages to generate the digital-to-analog output voltage.

* * * * *